US011976545B1

(12) United States Patent
Ashok et al.

(10) Patent No.: US 11,976,545 B1
(45) Date of Patent: May 7, 2024

(54) SYSTEMS AND METHODS FOR MONITORING SLIDE DRILLING OPERATIONS

(71) Applicant: Intellicess, Inc., Austin, TX (US)

(72) Inventors: Pradeepkumar Ashok, Austin, TX (US); John James D'Angelo, River Ridge, LA (US); Ian Rostagno, Kassel (DE)

(73) Assignee: Intellicess, Inc., Austin, TX (US)

( * ) Notice: Subject to any disclaimer, the term of this patent is extended or adjusted under 35 U.S.C. 154(b) by 799 days.

(21) Appl. No.: 17/013,046

(22) Filed: Sep. 4, 2020

Related U.S. Application Data

(60) Provisional application No. 62/897,009, filed on Sep. 6, 2019.

(51) Int. Cl.

| | |
|---|---|
| ***E21B 44/08*** | (2006.01) |
| ***E21B 7/04*** | (2006.01) |
| ***E21B 44/04*** | (2006.01) |
| ***E21B 49/00*** | (2006.01) |

(52) U.S. Cl.
CPC ..... *E21B 44/08* (2013.01); *E21B 7/04* (2013.01); *E21B 44/04* (2013.01); *E21B 49/003* (2013.01)

(58) Field of Classification Search
CPC . E21B 44/08; E21B 7/04; E21B 44/04; E21B 49/003
See application file for complete search history.

(56) References Cited

U.S. PATENT DOCUMENTS

| | | | | |
|---|---|---|---|---|
| 7,861,800 | B2 * | 1/2011 | Chapman | G06N 7/01 175/24 |
| 8,838,426 | B2 * | 9/2014 | Aldred | E21B 7/04 703/10 |
| 9,760,376 | B1 * | 9/2017 | Bequet | G06F 9/30181 |
| 9,900,378 | B2 * | 2/2018 | Zhang | G06F 9/4806 |
| 10,108,155 | B2 * | 10/2018 | Aldred | E21B 44/00 |
| 2010/0084191 | A1 * | 4/2010 | Chapman | G06N 7/01 175/24 |
| 2011/0220410 | A1 * | 9/2011 | Aldred | G05B 13/04 175/26 |
| 2012/0118637 | A1 * | 5/2012 | Wang | E21B 44/00 700/29 |

(Continued)

OTHER PUBLICATIONS

Non-Final Office Action, dated Jul. 29, 2022, six pages, issued in U.S. Appl. No. 15/908,451.

(Continued)

*Primary Examiner* — Ramesh B Patel
(74) *Attorney, Agent, or Firm* — AVEK IP, LLC

(57) ABSTRACT

Systems and methods for monitoring slide drilling operations and providing advisory information includes a Bayesian network having a slide drilling dysfunction output node and six input nodes including: a downhole mechanical specific energy (MSE) trend node; a downhole bit aggressiveness trend node; a differential pressure trend node; a minimum buckling load node; a downhole weight on bit (DWOB) vs surface weight on bit (SWOB) ratio node, and a toolface efficiency index node. When one or more dysfunctions are detected based on the information provided to one or more nodes, the system sends out one or more alerts and provides one or more corrective actions to return to efficient drilling.

20 Claims, 9 Drawing Sheets

(56) References Cited

U.S. PATENT DOCUMENTS

| | | | | |
|---|---|---|---|---|
| 2014/0277752 | A1* | 9/2014 | Chang | E21B 44/00 700/275 |
| 2014/0343694 | A1* | 11/2014 | Aldred | E21B 44/00 700/275 |
| 2015/0247396 | A1* | 9/2015 | Tunc | E21B 44/00 700/275 |
| 2016/0333673 | A1* | 11/2016 | Anno | G05B 15/02 |
| 2017/0096889 | A1* | 4/2017 | Blanckaert | E21B 44/00 |
| 2017/0223097 | A1* | 8/2017 | Zhang | G06F 9/3885 |
| 2017/0255468 | A1* | 9/2017 | Bequet | G06F 9/5027 |
| 2022/0275718 | A1* | 9/2022 | Ambrus | E21B 44/00 |

OTHER PUBLICATIONS

Notice of Allowance, dated Feb. 23, 2023, 5 pages, issued in U.S. Appl. No. 15/908,451.

* cited by examiner

SYSTEMS AND METHODS FOR MONITORING SLIDE DRILLING OPERATIONS

CROSS-REFERENCE TO RELATED APPLICATIONS

This application claims the benefit of priority of U.S. Provisional Patent Application No. 62/897,009, filed Sep. 6, 2019, the entire disclosure of which is incorporated herein by reference in its entirety.

TECHNICAL FIELD OF THE DISCLOSURE

The disclosure relates generally to drilling systems and methods. More specifically, the disclosure relates to systems and methods for monitoring slide drilling operations and providing recommendations for more efficient, safe, and/or effective slide drilling in real time.

BACKGROUND

Most oil and gas wells are intentionally deviated during the drilling operation. This can be done with a downhole steerable motor or with a rotary steerable system (RSS). Although RSSs provide a higher-quality wellbore, they are more expensive, so in most cases a downhole motor remains the preferred option. Deviating a well (slide drilling) with a downhole motor is usually done by experienced drillers and often considered an "art" due to the complexity of the operation. The value of their experience resides on them being able to monitor myriad parameters acquired by different sensors on the rig and making precise adjustments on the rig floor to drill in a specific desired direction. Regardless of the experience, this type of operation is still subject to several inefficiencies that most directional drillers do not have full control over. The volume of data collected by the rig sensors available for a modern drilling rig can be too large to be effectively processed by a human directional drilling operator or even a typical software program.

In slide drilling operations, most land wells and some off-shore wells are deviated using a downhole steerable motor, which is able to rotate just the bit, which is angled at a few degrees in relation to the drillstring. This is different from rotary drilling in that during slide drilling the entire drillstring is not rotated. Slide drilling allows for drilling long horizontal wells in massive shale formations, and has substantially increased oil and gas production worldwide in the past ten to fifteen years. Despite the success, deviated and horizontal wells are far from perfect. When drilling these wells, dysfunctions associated with the slide drilling operation can happen, resulting in low rates of penetration, hole cleaning problems, highly tortuous wells, premature damage to downhole drilling tools or even have a stuck drill pipe in the wellbore.

Slide drilling is usually done in short intervals of a few feet by experienced directional drillers to reduce the likelihood of dysfunctions. The driller controls the block height, hook-load, weight on bit (WOB), differential pressure (DP), flow rate, torque, toolface, surface RPM, and downhole RPM to drill in a predefined inclination and azimuth as fast as possible, without compromising wellbore quality or damaging any surface or downhole equipment. Wellbore quality decreases when the wellbore deviates from the original plan. When this happens, it is usually said that the tortuosity of the wellbore increases.

One source of tortuosity is the nature of this drilling procedure. Slide segments are not continuous and the various changes between sliding and rotary drilling intervals result in a well trajectory that is not a smooth curve, but an amalgamation of straight segments and turns. Corrections are continuously made at surface to try to keep a smooth trajectory, which is unfortunately never the case. Therefore, the wellbore zig-zags' around the original plan, increasing the tortuosity of the well.

The whole process is not an easy task, given that directional drillers try to control the direction of a bit that can be located up to twenty thousand or more feet downhole. Before a sliding interval, they position the bit in the desired direction, guided by a downhole tool that measures the inclination and azimuth of the drillstring a few feet above the bit and sends this information to the rig floor through mud pulses. It is then the task of the directional driller to interpret this information and project the position of the bit, also known as toolface angle. The orientation process becomes more challenging deeper in the well, as higher friction between the drillstring and the wellbore prevents surface weight and torque from effectively reaching the bit. This is also a challenge while slide drilling, because the bit will most likely try to deflect from the desired inclination and azimuth and the directional driller makes minor corrections from the surface to keep the drilling direction as steady as possible.

As mentioned previously, another problem associated with directional drilling is high friction. During a slide drilling operation, the bit rotates due to the rotational energy provided by the downhole motor, while the rest of the drillstring slides against the wellbore wall, continuously breaking static friction. The deeper the well, the longer the section that slides and the higher the friction. One immediate consequence of this is that the WOB signal typically available at the surface is inaccurate, as it is estimated without accounting for friction. Consequently, directional drillers cannot use this value to estimate how much force is applied against the formation and use the DP as an indicator instead. Not having a reliable estimate of how much weight is applied against the formation can cause several problems. On the one hand, the rate of penetration can be suboptimal if the weight is too low; on the other hand, the bit can be prematurely damaged, or drill pipes can be compressed and buckled if the weight is too high. Buckled drill pipes decrease the weight transfer to the bit even more resulting in the drill pipe being deformed in a helical geometry which can lock up the drill string into the wellbore or prematurely fail the drill pipe body.

One way in which directional drillers can reduce friction is through pipe rocking, which consists of alternatively rotating the drillstring from surface a few revolutions or 'wraps' to one direction and then to the other, making sure that only a fraction of the drillstring rotates in the wellbore. In most cases, pipe rocking is done either based on experience or by trial and error, and there is no real knowledge of what the reach of this rotary motion is. Suboptimal rocking regimes can lead to low friction reduction or poor control over the toolface angle.

Two other drilling dysfunctions that can happen during slide drilling are bit bouncing and stick/slip. Bit bouncing is a consequence of having an uneven friction distribution along the drillstring, by which elastic energy may be accumulated in some sections of the drillstring and be suddenly released, thus bouncing the bit against the formation. This action can damage the bit and/or the downhole motor. Lastly, if too much weight is applied against the bit and the selection of RPM is not large enough, the bit can momentarily stop and rotate again when enough torque is built up. This is known as stick/slip, which can reduce the rate of penetration and the control over the toolface angle.

The directional driller may be knowledgeable of all these drilling dysfunctions and tries to indirectly control them by monitoring the usually-available signals on surface. However, it is nearly impossible to keep control of all the signals while at the same time trying to drill in a constant direction as fast as possible.

SUMMARY

The following presents a simplified summary of the invention in order to provide a basic understanding of some aspects of the invention. This summary is not an extensive overview of the invention. It is not intended to identify critical elements or to delineate the scope of the invention. Its sole purpose is to present some concepts of the invention in a simplified form as a prelude to the more detailed description that is presented elsewhere.

According to one embodiment, a method for monitoring and controlling a downhole drilling operation includes providing a Bayesian network system, comprising a slide drilling dysfunction output node; a downhole mechanical specific energy trend input node; a downhole bit aggressiveness trend input node; a differential pressure trend input node; a minimum buckling load input node; a downhole weight on bit versus surface weight on bit ratio input node; and a toolface efficiency index input node. The method continues by receiving information from one or more sensors on a drilling rig and downhole tools for each of the respective input nodes; determining a probability of a dysfunction with the downhole drilling operation based on the information from the one or more sensors for each of the respective input nodes; and outputting, via the output node, an overall drilling dysfunction of the downhole drilling operation based on the respective probabilities of dysfunction.

According to another embodiment, a Bayesian network-based system for monitoring a downhole drilling operation includes a slide drilling dysfunction output node; and at least two input nodes selected from the list consisting of: a downhole mechanical specific energy trend input node; a downhole bit aggressiveness trend input node; a differential pressure trend input node; a minimum buckling load input node; a downhole weight on bit versus surface weight on bit ratio input node; and a toolface efficiency index input node. The respective input nodes receive information from one or more sensors on a drilling rig. Each respective input node determines a probability of a dysfunction with the downhole drilling operation based on the information from the one or more sensors. The output node outputs an overall drilling dysfunction of the downhole drilling operation based on the respective probabilities of dysfunction. A recommended corrective action is advised for resolving the overall drilling dysfunction.

According to a further embodiment, a method for monitoring downhole drilling operation includes the steps of: receiving electronic drilling recorder data or sensor data from a plurality of sensors; determining a threshold feature for a first input node; determining a movement feature for a second input node; converting the threshold feature and the movement feature to an output state with a Bayesian network at an output node; converting the output state to a corrective action; and displaying the corrective action through a user interface.

BRIEF DESCRIPTION OF THE DRAWINGS

Illustrative elements of the invention are described in detail below with reference to the attached figures.

DETAILED DESCRIPTION

The following describes some non-limiting exemplary embodiments of the invention with references to the accompanying FIGS. 1-9. The described embodiments are merely a part rather than all of the embodiments of the invention. All other embodiments obtained by a person of ordinary skill in the art based on the embodiments of the disclosure shall fall within the scope of the disclosure.

Systems and methods for monitoring directional drilling and providing advisory information are described herein.

In embodiments, methods to monitor both the efficiency of the directional driller and the likelihood of having one or more of drilling dysfunctions, and to provide recommendations for more effective slide drilling are proposed. As is described in greater detail below, this may be done by constantly monitoring many signals relevant to the slide drilling operation in real time while at the same time performing calculations that give clearer indications if any problems are happening or may be likely to happen.

Figure 1:
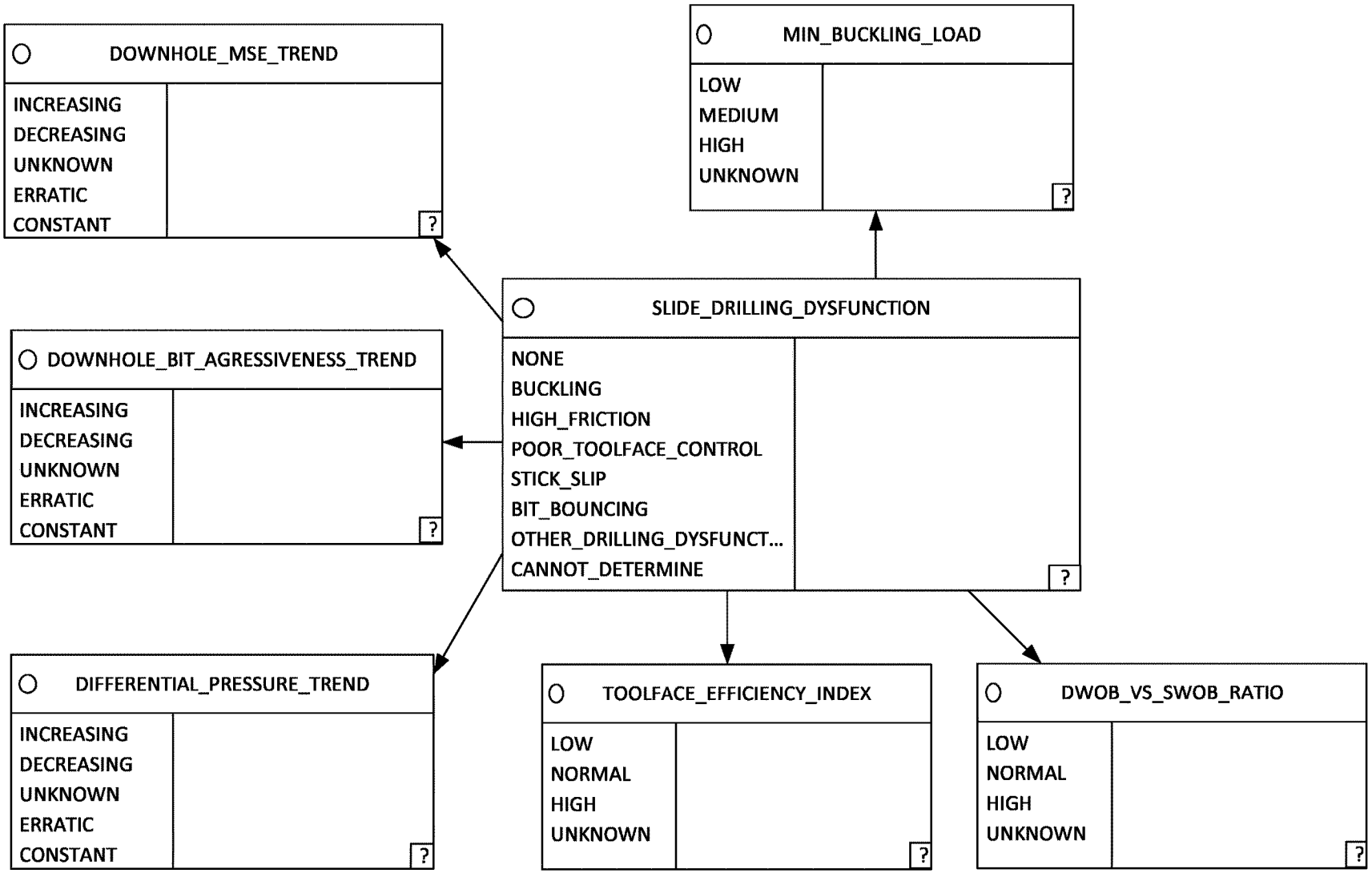
FIG. 1 shows an exemplary Bayesian network for detecting slide drilling dysfunctions.
Figure 2:
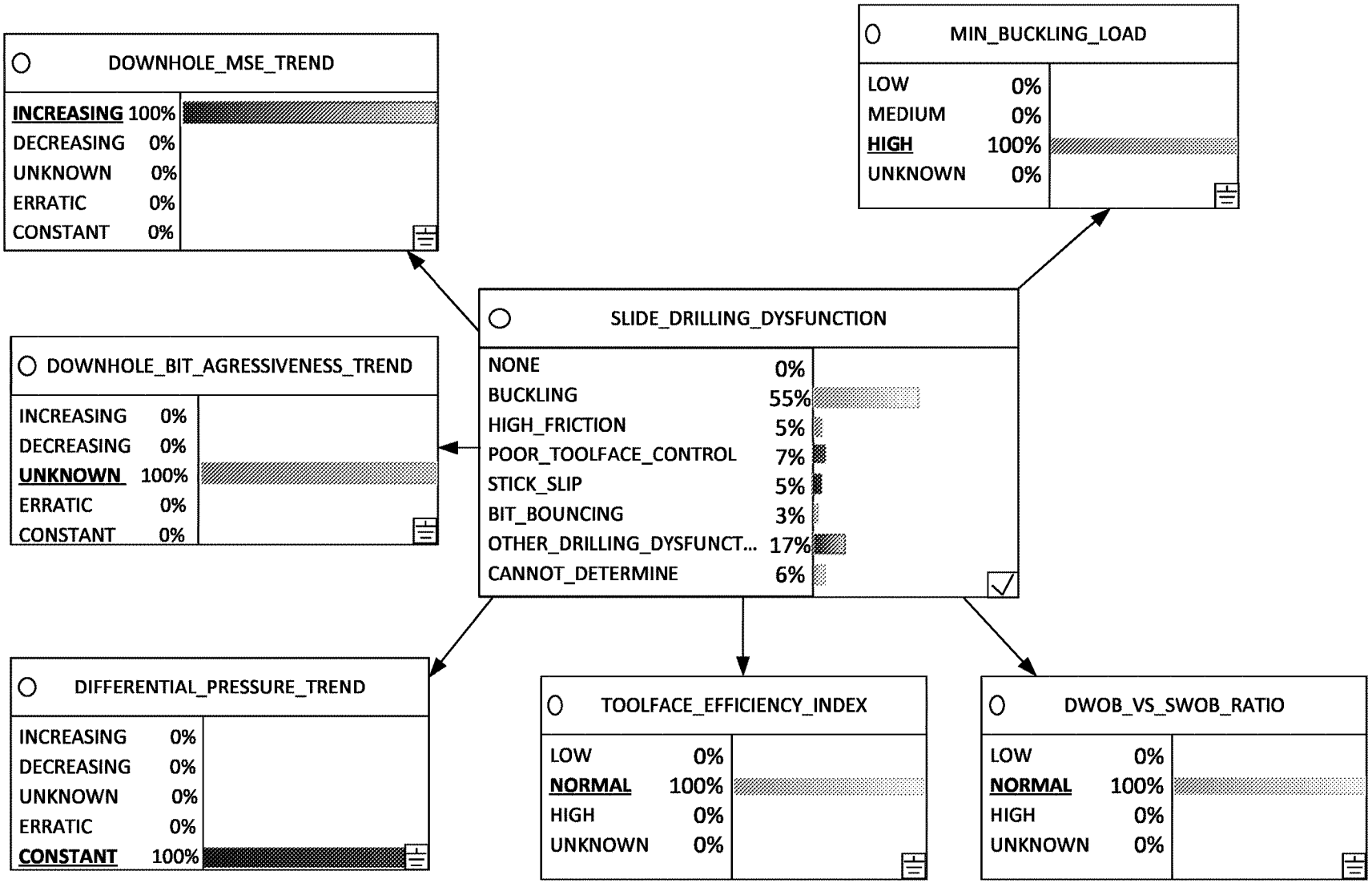
FIG. 2 shows an example in which the Bayesian network detects a high risk of buckling.

Optionally, the methods leverage a Bayesian network with six input nodes and one output node as shown in FIG. 1. The input nodes require information that can be derived directly from sensor data, or through calculations made by combining sensor data with physics based models. The data needed are commonly available electronic drilling recorder (EDR) data and may include one or more of rate of penetration (ROP), surface torque on bit (STOB), revolutions per minute (RPM), gravity toolface, magnetic toolface, hookload, block height, hole depth, bit depth, surface weight on bit (SWOB), standpipe pressure, differential pressure, etc.

Functions and features of six input nodes and one output node in the Bayesian network are further explained in Table 1, below. The conditional probability tables that relate the nodes in the networks may be learnt from historical data sets. The learning may be implemented by artificial intelligence algorithms.

TABLE 1

Features for determining slide drilling dysfunctions.

| Node | Description |
|---|---|
| SLIDE_DRILLING_DYSFUNCTION | Depends on output states of all the other nodes. It assigns the probability of the slide drilling dysfunction being: NONE, BUCKLING, HIGH_FRICTION, POOR_TOOLFACE_CONTROL, STICK_SLIP, BIT_BOUNCING, OTHER_DRILLING_DYSFUNCTIONS, or CANNOT_DETERMINE |
| DOWNHOLE_MSE_TREND | An estimation of the energy input into the system downhole to remove a certain volume of rock. This node assigns the probability that the downhole MSE trend is either: INCREASING, DECREASING, CONSTANT, ERRATIC, or UNKNOWN. |
| DOWNHOLE_BIT_AGGRESSIVENESS_TREND | An estimation of the work done by the bit downhole. This node assigns the probability that the downhole bit aggressiveness trend is either: INCREASING, DECREASING, CONSTANT, ERRATIC, or UNKNOWN. |
| DIFFERENTIAL_PRESSURE_TREND | The node assigns the probability that the differential pressure trend is either: INCREASING, DECREASING, CONSTANT, ERRATIC, or UNKNOWN. |
| TOOLFACE_EFFICIENCY_INDEX | An indication of the efficiency of the directional driller to maintain a constant toolface during a sliding interval. This node assigns the probability that the efficiency of the directional driller is either: LOW, NORMAL, HIGH, or UNKNOWN. |
| MIN_BUCKLING_LOAD | An indication of the minimum axial load required to buckle at least one pipe in the drillstring. This node assigns the probability that the risk of buckling a joint in the drillstring is either: LOW, MEDIUM, HIGH, or UNKNOWN. |
| DWOB_VS_SWOB_RATIO | An indication of the efficiency with which weight is transferred to the bit. This node assigns the probability that the efficiency in weight transfer is either: LOW, NORMAL, HIGH, or UNKNOWN |

The DWOB VS SWOB RATIO node is an indication of the efficiency with which weight is transferred to the bit. This node assigns the probability that the efficiency in weight transfer is either: LOW, NORMAL, HIGH, or UNKNOWN. The surface weight on bit (SWOB) data available from an EDR does not represent the true downhole weight on bit (DWOB). Friction between the drill string and the wellbore result in the DWOB being lower than the SWOB, and the ratio between them is one of the indicators for high friction.

There are numerous models to estimate DWOB. This often requires data beyond what is available from an EDR, namely, survey data, mud motor information, bottom-hole assembly and drill string details, hole geometry, and mud properties. One approach uses a soft string torque and drag model to account for the weight of the drillstring and the sliding friction loss along the wellbore. The drillstring is modeled as short elements, which are assigned values of internal diameter (ID), outer diameter (OD), steel weight, mud weight, inclination, and azimuth from relevant input into the system. The actual buoyant weight of each element is estimated using the relationship between steel and mud weight. When drilling is taking place, the drillstring is known to be moving down and to have weight applied to the bit. The soft string torque and drag model uses the weight and friction acting along each element to propagate the axial force applied at the bit up to the surface as though the drill string were a chain or rope. The result is that the compressive force at the bit eventually gives way to a tensile force at the surface. This tensile force plus the weight of the traveling block should equal the hook load while drilling.

The method for estimating DWOB may start with an initial guess of the weight applied to the bit, and then employs a root-finding algorithm that varies the friction factor (FF) to find an estimate of the weight being applied at the bit that minimizes the difference between the model estimate and the latest hook-load measurement. This value is taken as the downhole weight on bit (DWOB). The model needs to be periodically calibrated to yield accurate results. This is done by selecting specific values of hookload when the bit is off-bottom (i.e., when DWOB is assumed to be zero).

The FF is not always constant. Some more complex scenarios require a deeper look into physics to better represent the conditions downhole. Two good examples of this are the addition of drilling agitator tools to the drillstring, the use of pipe rocking or even a combination of these two. In these situations, some sections of the drillstring break into dynamic friction and others under remain static at the same time, requiring a different type of modeling. The complexity of these scenarios involves estimating which sections of the drillstring are under dynamic friction and what FF should be used in these sections. A methodology is used here to estimate the reach of the agitator tool and its effect on friction reduction. Additionally, pipe rocking is simulated to estimate the reach of the rotational effect downhole. Once a solution is found, a coefficient between DWOB and SWOB is calculated to determine if the weight transfer to the bit is low, normal or high. As shown in FIG. 1, the result is displayed in the DWOB VS SWOB RATIO node.

The DOWNHOLE_MSE_TREND node is an estimation of the energy input into the system downhole to remove a certain volume of rock. This node assigns the probability that the downhole MSE trend is either: INCREASING, DECREASING, CONSTANT, ERRATIC, or UNKNOWN. While slide drilling, it is assumed that any torque applied on surface for rocking the pipe gets dampened along the drillstring and does not reach the bit. Downhole torque on bit (DTOB) is the torque provided by the downhole motor and is dependent on the characteristics of the downhole motor, flow rate, and differential pressure. DWOB and DTOB are of relevance for calculating the downhole mechanical specific energy (MSE), which is an estimation of the energy required to destroy a unit volume of rock. MSE is calculated using the below equation.

$$MSE_{Downhole} = \frac{4*1000*DWOB}{\pi*D_{bit}^2} + \frac{480*(RPM_{surf}+Q*RPG)*\left(\frac{T_{max}}{DP_{max}}\right)*DP}{D_{bit}^2*ROP}$$

In the above equation, $D_{bit}$ is the diameter of the bit, $RPM_{surf}$ is the RPM applied from surface by the top drive, Q is the total flow rate of drilling fluid, RPG is the proportionality constant relating the flow rate to the RPM produced by the downhole mud motor, and ROP is the current rate of penetration. $T_{max}$ is the maximum rated mud motor torque, and $DP_{max}$ is the maximum rated differential pressure. These two constants are provided by the mud motor manufacturer, and their ratio is the proportionality constant relating the current differential pressure (DP) to the torque exerted by the mud motor (also called DTOB).

The absolute value of MSE by itself may not be completely valuable, but the trend of MSE is an indication of the drilling efficiency. Different drilling dysfunctions are associated with different MSE trends. Thus, the MSE information calculated is used in the Bayesian network as an input to the node DOWNHOLE_MSE_TREND.

The DOWNHOLE_BIT_AGGRESSIVENESS_TREND node is an estimation of the work done by the bit downhole. This node assigns the probability that the downhole bit aggressiveness trend is either: INCREASING, DECREASING, CONSTANT, ERRATIC, or UNKNOWN. Bit aggressiveness relates the torque applied at the bit to the weight applied to the formation. It may be calculated using the below equation.

$$BitAggressiveness_{Downhole} = 36*\left(\frac{T_{max}}{DP_{max}}\right)*\frac{DP}{DWOB*1000*D_{bit}}$$

In the above equation, the bit aggressiveness is dependent on DTOB and DWOB, and its trend can be an indication of different drilling dysfunctions (FIG. 1, Node DOWNHOLE_BIT_AGGRESSIVENESS_TREND). Similarly, the trend of differential pressure is also used to account for slide drilling dysfunctions. As shown in FIG. 1, it is calculated in the DIFFERENTIAL_PRESSURE_TREND node.

The TOOLFACE_EFFICIENCY_INDEX node is an indication of the efficiency of the directional driller to maintain a constant toolface during a sliding interval. This node assigns the probability that the efficiency of the directional driller is either: LOW, NORMAL, HIGH, or UNKNOWN. In slide drilling, one concern is the directional drillers' ability to maintain a constant toolface during a sliding interval. Wells with high tortuosity can not only make drilling ahead difficult, but also be the cause of reduced production rates in the future. A toolface efficiency index (TEI) is calculated to monitor the ability of the directional driller to keep a constant toolface in real time. The TEI calculates the average of toolface, weighted per distance drilled, of the last 2 ft that was slide drilled. This value is taken to the polar space and the difference between the toolface average and the actual toolface value is calculated. This difference is finally normalized, yielding a value of 1 when the toolface exactly matches the average, and a value of 0 when the difference is 180 degrees. The result is an index that indicates if the toolface efficiency is low, normal or high. As shown in FIG. 1, it is calculated in the TOOLFACE_EFFICIENCY_INDEX node.

Finally, the MIN_BUCKLING_LOAD node is an indication of the minimum axial load required to buckle at least one pipe in the drillstring. This node assigns the probability that the risk of buckling a joint in the drillstring is either: LOW, MEDIUM, HIGH, or UNKNOWN. In slide drilling, a major dysfunction is drill pipe buckling. Drill pipes are designed to work under tension, but there are situations, specifically when drilling horizontal wells, when drill pipes can be working under compression. One good example of this is when the weight applied downhole is too large, with no clear indication of this on surface due to high friction along the drillstring. Compressed drill pipes deform easily, and they adopt different shapes. The most dangerous scenario is helical buckling, in which the drill pipe deforms as a spring pressing against the formation, increasing friction severely and potentially locking up the drillstring into the wellbore. Optionally, the described system includes a pipe helical buckling indicator. The axial load on each joint is estimated with the torque and drag model previously described. At the same time, the critical compression load required to buckle a drill pipe into a helical geometry is calculated based on the pipe geometry, material, and radius of curvature in which it is deformed inside the wellbore and inclination angle. The minimum difference between the critical load and the actual load on all the joints in the drillstring is the minimum axial load required to buckle at least one pipe. The risk of buckling a drill pipe is quantified as low, medium, or high and is displayed in the MIN_BUCKLING_LOAD node in the Bayesian network shown in FIG. 1. All calculations of the above six nodes may be mapped to feature probabilities that feed into nodes of the Bayesian Network as shown in Table 2. Table 2 shows the name of each of the six input nodes along with the calculated features used to develop the feature probability for that node. Each node has a specific type of feature. Some nodes have "movement" features and others have "threshold" features. The nodes are connected in an arrangement which allows for the probability of having a certain drilling dysfunction to be calculated based on the calculated node probabilities and the known conditional probabilities amongst the nodes.

TABLE 2

Features mapping of slide drilling dysfunction nodes.

| Node Name | Calculated Value(s) | Feature Mapping Type |
|---|---|---|
| Downhole MSE Trend | Downhole MSE values calculated over the past 120 seconds | Movement feature |

TABLE 2-continued

Features mapping of slide drilling dysfunction nodes.

| Node Name | Calculated Value(s) | Feature Mapping Type |
|---|---|---|
| Downhole Bit Aggressiveness Trend | Downhole bit aggressiveness values calculated over the past 120 seconds | Movement feature |
| Differential Pressure Trend | Differential pressure values calculated over the past 100 seconds | Movement feature |
| Minimum Buckling Load | Minimum buckling WOB<br>Calculated downhole WOB | Threshold feature |
| DWOB vs SWOB Ratio | Calculated downhole WOB<br>Calculated surface WOB | Threshold feature |
| Toolface Efficiency Index | Toolface efficiency index | Threshold feature |

Threshold features are calculated directly from the sensed and calculated data. As shown in Table 2, minimum buckling load, DWOB vs SWOB ratio, and toolface efficiency index have "threshold" features. For minimum buckling load, the threshold feature is the current difference between the minimum buckling WOB and the calculated downhole WOB. For the DWOB vs SWOB ratio, it is the current ratio of DWOB to SWOB, i.e. (DWOB/SWOB). And for the SWOB toolface efficiency index, the threshold feature is the instantaneous value of the toolface efficiency index.

Whatever the specific value is, the process for a threshold feature mapping may be the same. For generality, the calculated value is referred to as "v" and resultant probability as "P". Three thresholds are identified, namely HIGH, MEDIUM, and LOW. In some cases, "NORMAL" is used in place of "MEDIUM", as with the DWOB vs SWOB Ratio node, but the meaning is the same. With these values defined, the probability mapping is shown in the following codes.

High if($v$ >= MEDIUM AND $v$ < HIGH)

$$P(\text{High}) = \frac{v - \text{MEDIUM}}{\text{HIGH} - \text{MEDIUM}}$$

-continued otherwise if($v$ >= HIGH)

$P$(High) = 1 otherwise $P$(High) = 0

Medium if($v$ >= MEDIUM AND $v$ < HIGH)

$$P(\text{Medium}) = 1 - \frac{(v - \text{MEDIUM})}{\text{HIGH} - \text{MEDIUM}}$$

else if($v$ < MEDIUM AND $v$ >= LOW)

$$P(\text{Medium}) = \frac{(v - \text{LOW})}{(\text{MEDIUM} - \text{LOW})}$$

else $P$(Medium) = 0

Low if($v$ < MEDIUM AND $v$ >= LOW)

$$P(\text{Low}) = 1 - \frac{(v - \text{LOW})}{(\text{MEDIUM} - \text{LOW})}$$

else if($v$ < LOW)

$P$(Low) = 1 else $P$(Low) = 0

Unknown $P$(Unknown) = 1 − $P$(High) − $P$(Medium) − $P$(Low)

Movement features are mapped from the last several data points of a particular calculated value saved as a time series. As shown in Table 2, differential pressure, downhole MSE, and downhole bit aggressiveness trends have "movement" features. The time series is used to fit a linear trend line with slope m and intercept b. The standard deviation, a is also calculated. A threshold, LINEAR_THRESHOLD, is set on m such that when the absolute value of m is above the threshold, the trend is considered linear and changing. The size of the time series is assumed to be small enough that possible nonlinearity of the series can be ignored. A second threshold, STANDARD_DEV_THRESHOLD, is set to represent an above average amount of variation in the time series. The movement feature mappings are then calculated as shown in the following codes.

Increasing

If($m$ >= 0 AND $m$ < LINEAR_THRESHOLD)

If($\sigma$ >= STANDARD_DEV_THRESHOLD/4)

$$P(\text{Decreasing}) = \left(\frac{|m|}{\text{LINEAR_THRESHOLD}}\right) * \left(1 - \min\left(\frac{\sigma}{\text{STANDARD_DEV_THRESHOLD}}, 1\right)\right)$$

Otherwise $$P(\text{Decreasing}) = \frac{|m|}{\text{LINEAR_THRESHOLD}}$$

Otherwise if($M$ < 0)

$P$(Decreasing) = 0

Otherwise

If($\sigma$ >= STANDARD_DEV_THRESHOLD/4)

-continued $$P(\text{Decreasing}) = \left(1 - \min\left(\frac{\sigma}{\text{STANDARD_DEV_THRESHOLD}}, 1\right)\right)$$

Otherwise $$P(\text{Decreasing}) = 1$$

Decreasing

If($m$ <= 0 AND $m$ > −LINEAR_THRESHOLD)

If($\sigma$ >= STANDARD_DEV_THRESHOLD/4)

$$P(\text{Decreasing}) = \left(\frac{|m|}{\text{LINEAR_THRESHOLD}}\right) * \left(1 - \min\left(\frac{\sigma}{\text{STANDARD_DEV_THRESHOLD}}, 1\right)\right)$$

Otherwise $$P(\text{Decreasing}) = \frac{|m|}{\text{LINEAR_THRESHOLD}}$$

Otherwise if($M$ > 0)

$P$(Decreasing) = 0

Otherwise

If($\sigma$ >= STANDARD_DEV_THRESHOLD/4)

In addition to the normal feature mappings, at times when there is insufficient information to properly calculate the necessary inputs for a particular node, the node's "Unknown" probability may be set to 1 and all its other states may be set to 0. This is to prevent incomplete or inaccurate information from skewing the probability estimation.

All the nodes may be provided inputs through calculations done in real time. Some nodes may have a higher influence on specific drilling dysfunctions than others, and this may be learnt from historical datasets. As described above, the learning may be implemented by artificial intelligence algorithms.

Figure 3:
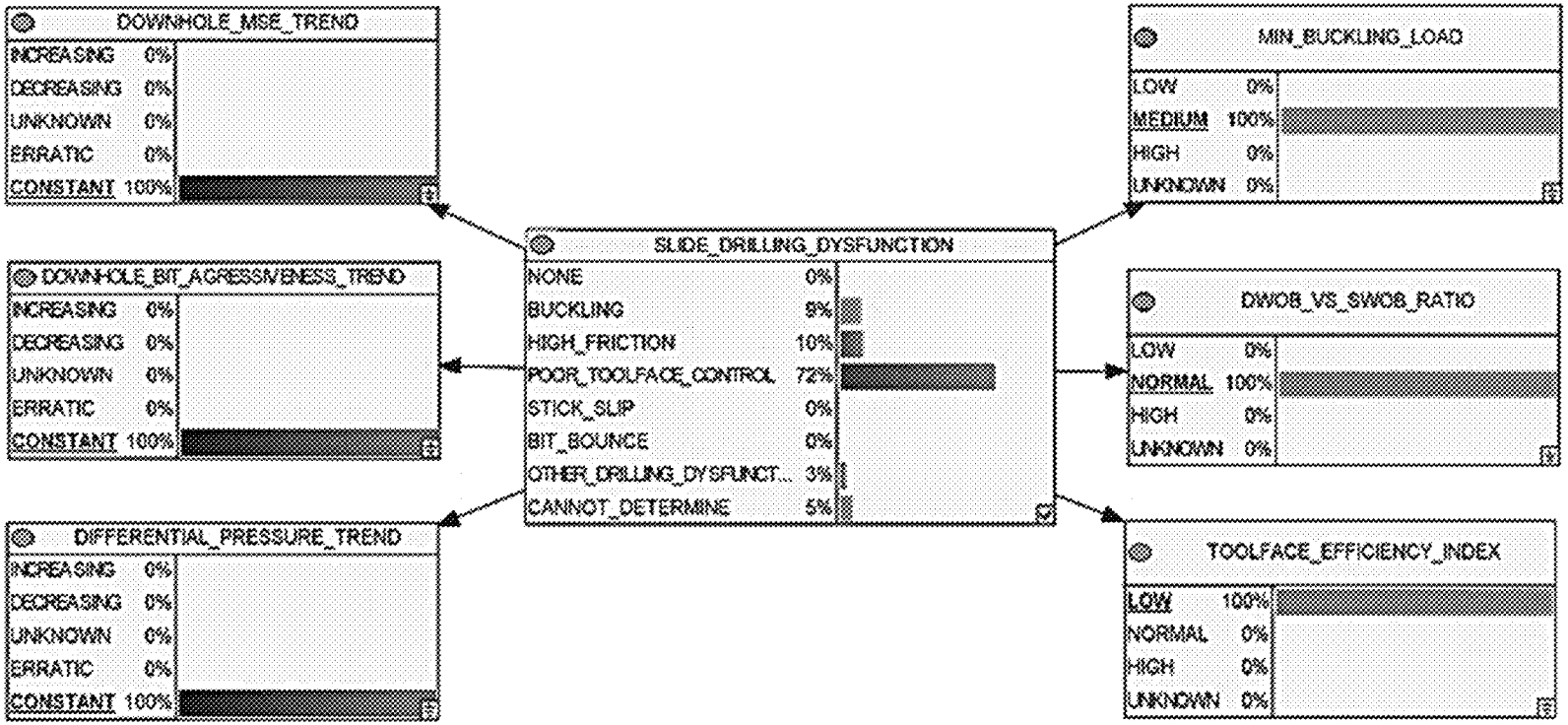
FIG. 3 shows an example in which the Bayesian network detects a high risk of poor toolface control.

FIGS. 3-6 illustrate various exemplary illustrations of the Bayesian network in use. In FIG. 3, the network has determined that there is a high risk of poor tool face control. The network determined that the energy input to the system (i.e., DOWNHOLE_MSE_TREND), the work done by the bit (i.e., DOWNHOLE_BIT_AGGRESSIVENESS_TREND), and the differential pressure trend (i.e., DIFFERENTIAL_PRESSURE_TREND) is constant. The efficiency of weight transfer is normal (i.e., DWOB VS SWOB RATIO). However, there is medium risk of buckling a joint in the drillstring (i.e., MIN_BUCKLING_LOAD). Additionally, the efficiency of the directional driller to maintain a constant toolface during a sliding interval (i.e., TOPLFACE_EFFICIENCY_INDEX) is estimated to be low. Taken together, the network determines that there is elevated risk (in this case, about 72% chance) of poor toolface control.

Figure 4:
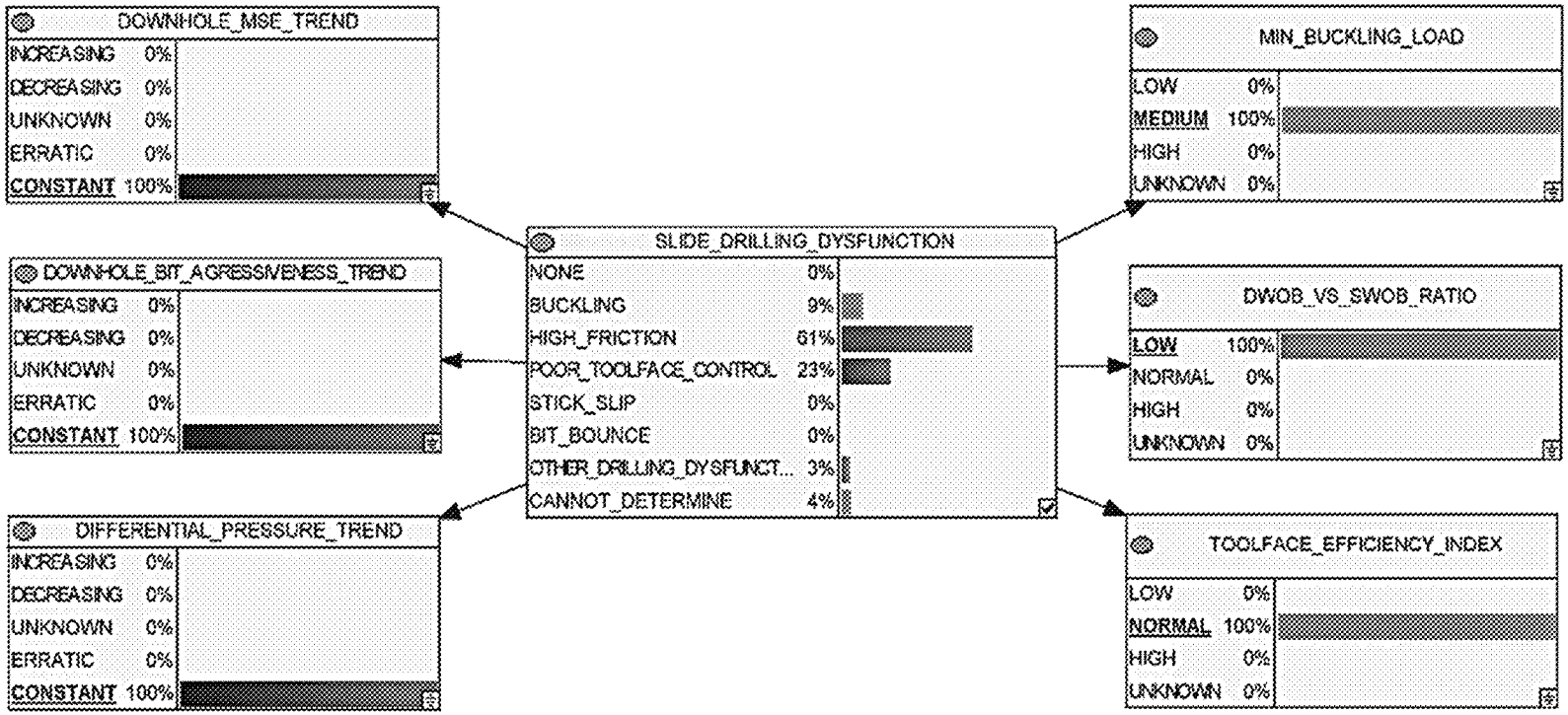
FIG. 4 shows an example in which the Bayesian network detects a high risk of high friction.

In FIG. 4, there is some risk of poor toolface control, but it is significantly reduced as compared to FIG. 3. Here instead, there is a high estimation, around 61%, that the drillstring is experiencing high friction within the wellbore. As in FIG. 3, the network determined that the energy input to the system (i.e., DOWNHOLE_MSE_TREND), the work done by the bit (i.e., DOWNHOLE_BIT_AGGRESSIVENESS_TREND), and the differential pressure trend (i.e., DIFFERENTIAL_PRESSURE_TREND) is constant. Additionally, the efficiency of the directional driller to maintain a constant toolface during a sliding interval (i.e., TOPLFACE_EFFICIENCY_INDEX) is estimated to be normal. Here, however, the efficiency of weight transfer is low (i.e., DWOB VS SWOB RATIO), meaning that the downhole weight on bit (DWOB) is lower than the surface weight on bit (SWOB) suggesting friction between the drillstring and the wellbore. There is also medium risk of buckling a joint in the drillstring (i.e., MIN_BUCKLING_LOAD). Taken together, the network determines that there is elevated risk of high friction.

Figure 5:
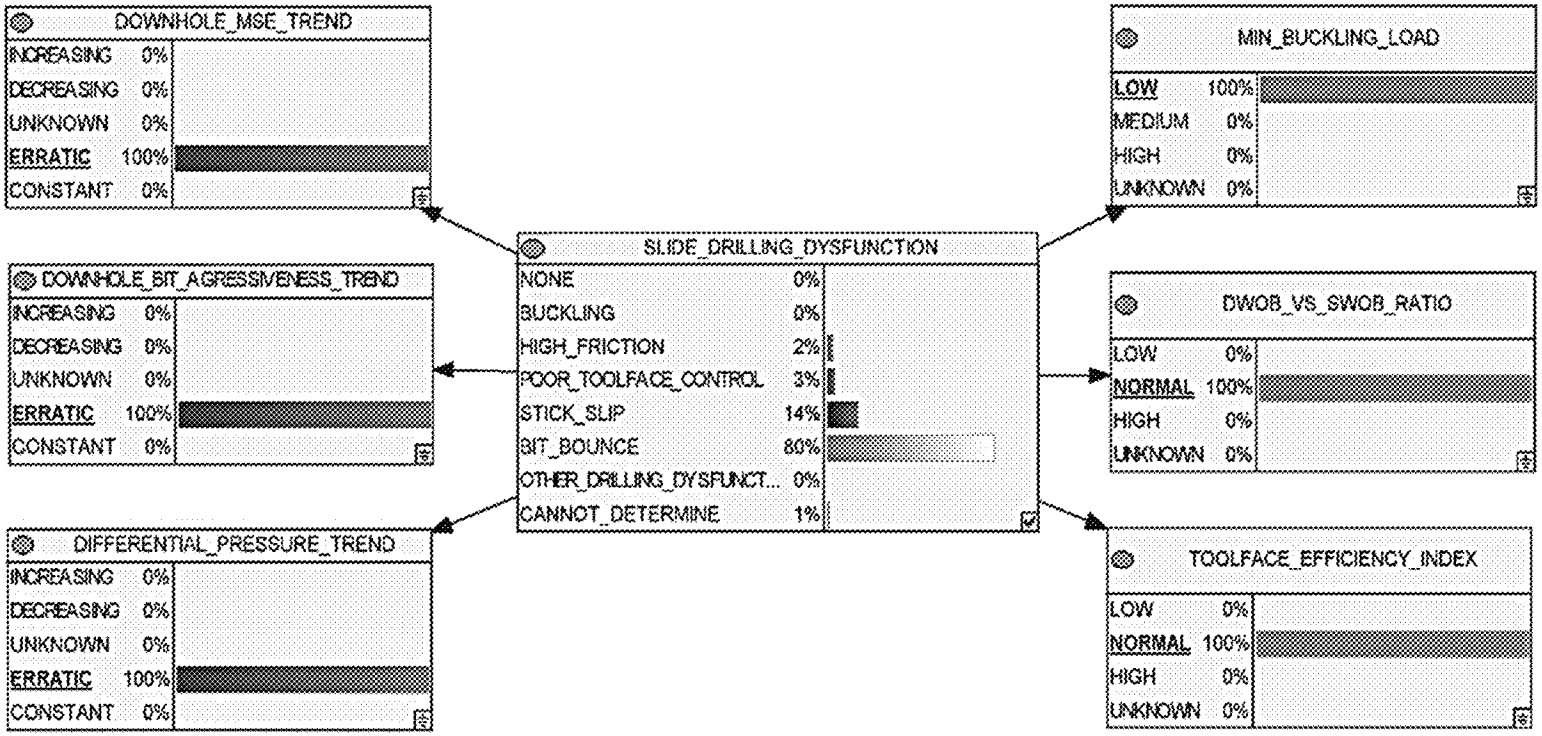
FIG. 5 shows an example in which the Bayesian network detects a high risk of bit bounce.

Moving on to FIG. 5, there is indication that the energy input to the system (i.e., DOWNHOLE_MSE_TREND), the work done by the bit (i.e., DOWNHOLE_BIT_AGGRESSIVENESS_TREND), and the differential pressure trend (i.e., DIFFERENTIAL_PRESSURE_TREND) is erratic. There is low risk of buckling a joint in the drillstring (i.e., MIN_BUCKLING_LOAD). The efficiency of the directional driller to maintain a constant toolface during a sliding interval (i.e., TOPLFACE_EFFICIENCY_INDEX) is estimated to be normal. Additionally, the efficiency of weight transfer (i.e., DWOB VS SWOB RATIO) is normal. Based on the probabilities of the trends being erratic, the network determines that there is high likelihood of bit bounce.

Figure 6:
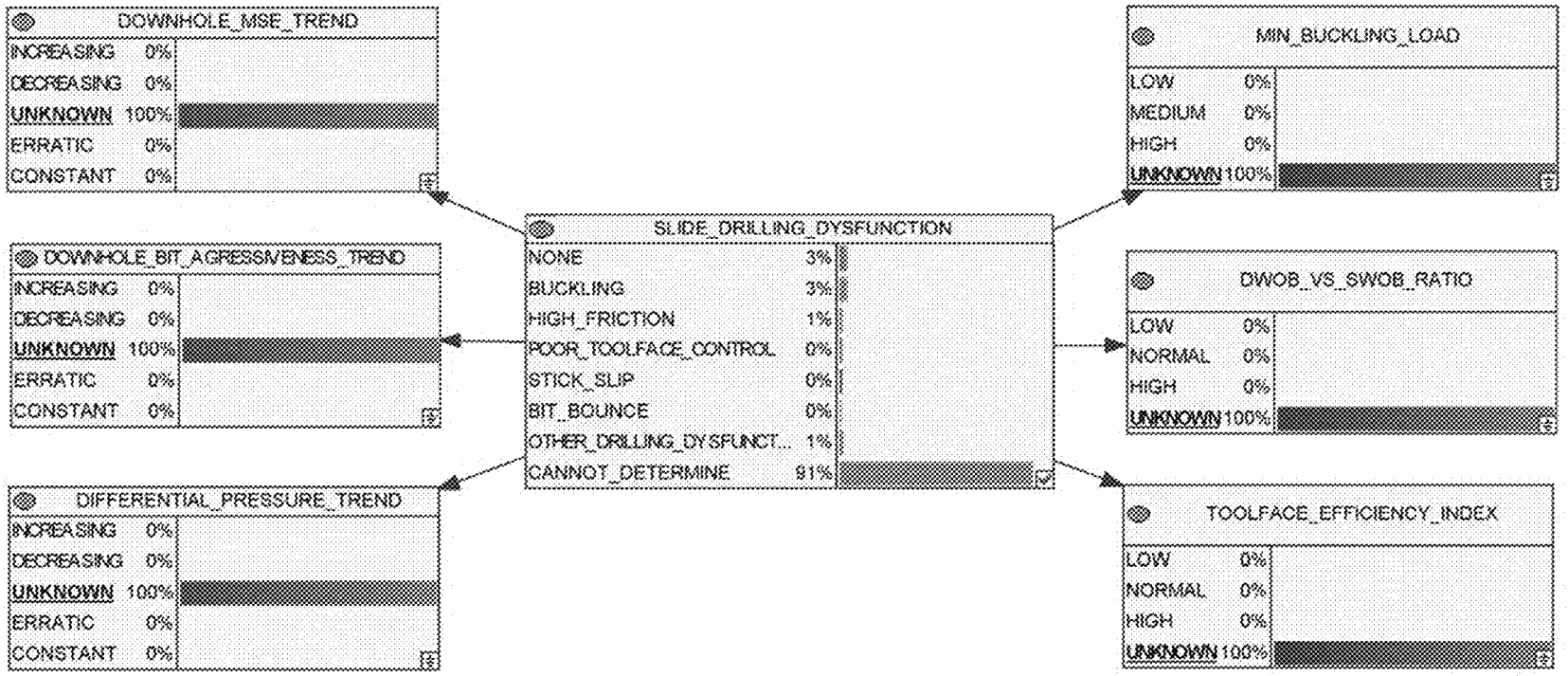
FIG. 6 shows an example in which the Bayesian network detects insufficient information to determine probability of any drilling dysfunction.

There may be some cases in which one or more of the calculated values cannot be properly obtained by the system. This can happen, for example, if required information is not provided, or if the signal is not being properly transmitted. If this is the case, those nodes with calculated values that cannot be obtained will yield an UNKNOWN state. If many of the nodes have UNKNOWN outcomes, then it will not be safe to determine a particular slide drilling dysfunction and the output of the network will be CANNOT DETERMINE. The output of the system thus degrades gracefully when less information is available. This is illustrated in FIG. 6.

Figure 7:
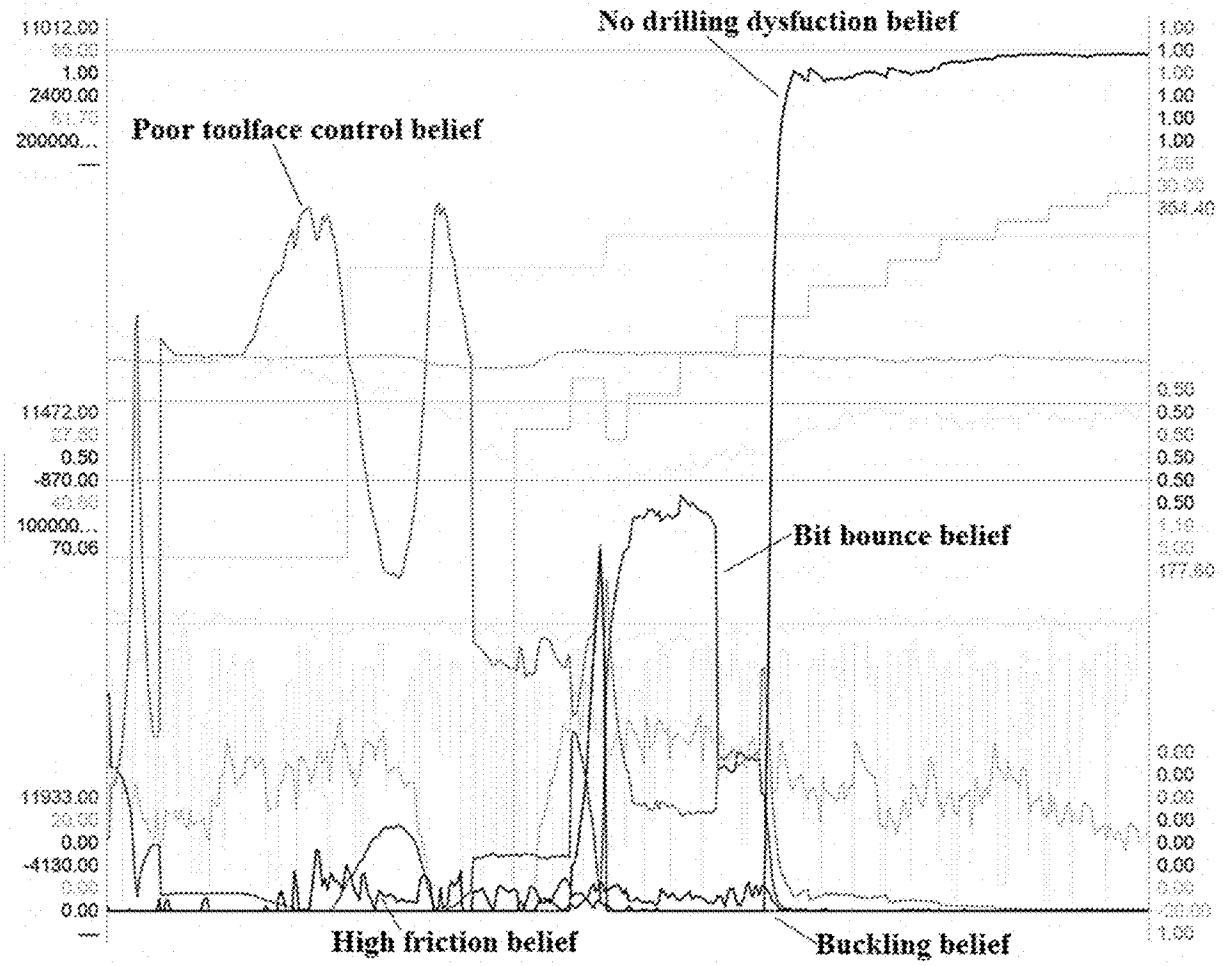
FIG. 7 shows an exemplary graphical result of running the drilling dataset through the software.

The final output of the network is a graphical illustration of the probabilities of experiencing different drilling dysfunctions. FIG. 7 shows exemplary results of running the software on a typical drilling dataset. The different signals represent the probability of having certain drilling dysfunction. Specifically, in FIG. 7, the graph illustrates poor toolface control belief, high friction belief, bit bounce belief, buckling belief, and no drilling dysfunction belief. An operator can review the graph and tell relatively quick what adjustments, if any, are required.

Since the output of the network is the set of probabilities for different drilling dysfunctions, there needs to be some logic that determines whether or not a dysfunction has been "detected" and which dysfunction(s) to report. Dysfunctions are detected when the probability of the most probable dysfunction exceeds its associated threshold. Each dysfunction has a unique threshold which can be set on a measured depth basis, since the desired threshold may vary from one section of the well to the next. Constant values of 0.5 are also common.

Figure 8:
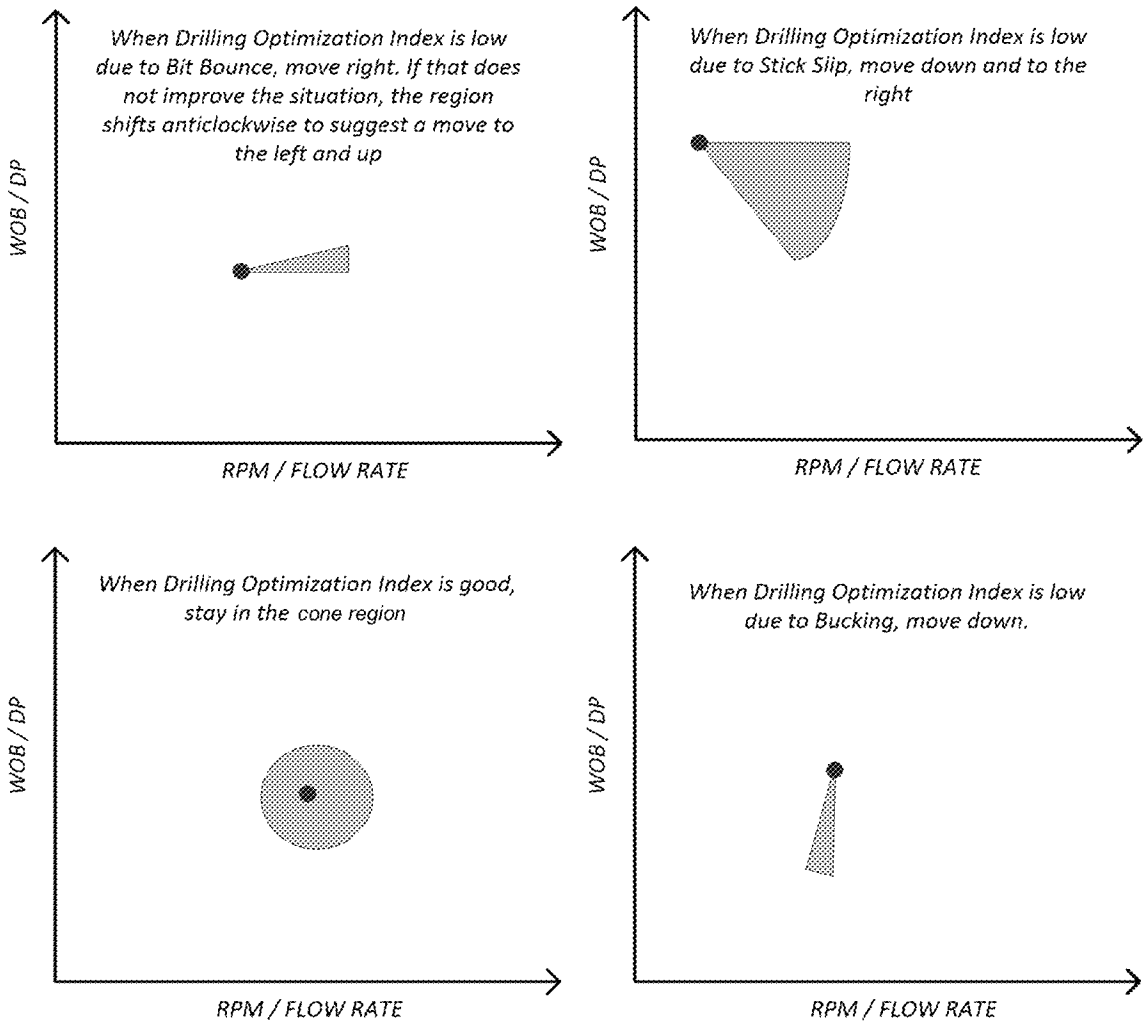
FIG. 8 shows exemplary graphical representations of cone drilling behavior during slide drilling.
Figure 9:
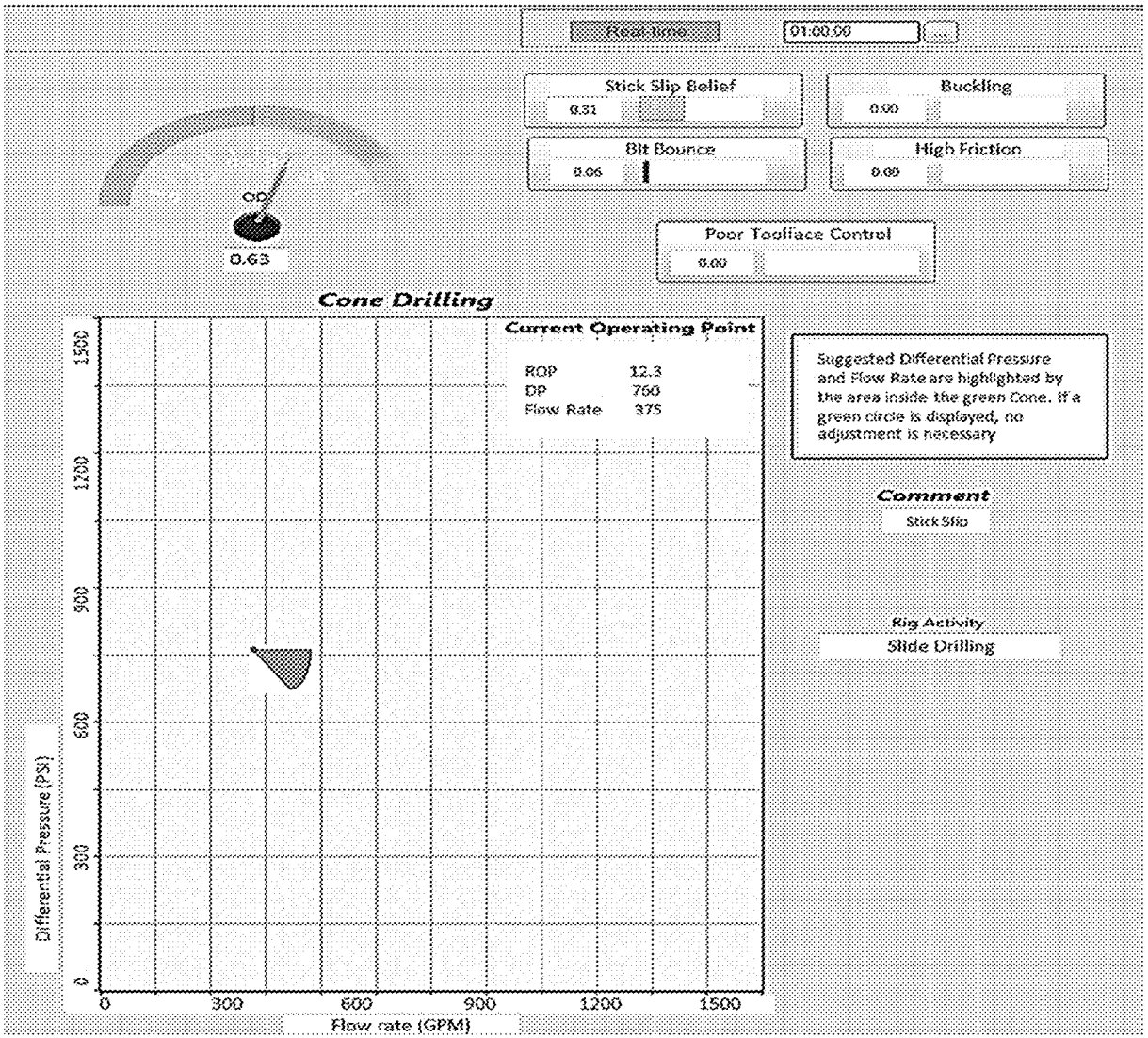
FIG. 9 shows an exemplary screenshot of a graphical user interface in the driller's cabin providing slide drilling guidance.

If a dysfunction is detected, the system sends out an alert to the rig floor and provides corrective actions to the driller to return to efficient drilling. One example is illustrated in FIG. 8, showing plots of WOB or DP on the "y" axis, with Flow Rate or RPM in the "x" axis. WOB is expected to be linearly related to DP, and RPM is proportional to Flow Rate. If no slide drilling dysfunction is detected, a small circle just shows the values of the mentioned signals in the plot. When inefficient drilling is detected, the circle changes its shape to a cone, suggesting that a change in parameters is required in the direction of the cone. The driller may read out the alert information and control a drilling operation in real time through a user interface as shown in FIG. 9. The corrective actions for each drilling dysfunction are summarized in Table 3 and schematized in FIG. 8.

TABLE 3

Corrective actions for the different slide drilling dysfunctions.

| Slide drilling dysfunction | Corrective action |
|---|---|
| Buckling | Reduce DP (WOB). |
| Bit Bouncing | First, increase Flow Rate (RPM). If the dysfunction persists at higher Flow Rate (RPM), reduce Flow Rate (RPM) to the original level and increase DP (WOB). |
| Stick/Slip | Increase Flow Rate, decrease DP (WOB). |
| High Friction | Analyze hole cleanliness and potentially suggest adopting a different pipe rocking regime |
| Poor Toolface Control | Alert the directional driller |

If the drilling dysfunction indicates poor toolface control, the directional driller may choose to modify the drilling mode. The directional driller may utilize a rotating mode and a sliding mode for drilling. In the rotating mode, the entire drillstring may rotate to transmit power to the bit. In the sliding mode, the drillstring does not rotate. Rather, a downhole motor turns the bit and the hole is drilled however, the bit is pointing, which is based on the toolface orientation. The directional driller may operate in rotating mode or sliding mode depending on the desired course. With poor toolface control, the bit may deviate from the intended course, which may cause the directional driller to switch modes to correct course (e.g., from rotating mode to sliding mode, or vice versa). Once the course is corrected, the driller may switch modes again and continue drilling.

If no drilling dysfunction is detected, the probabilities of the other drilling dysfunctions are compared to see if there are multiple possible dysfunctions. If that is the case, multiple dysfunctions are reported, and the rig crew could check the probabilities to see which of the dysfunctions are most probable. No drilling cone is provided in such a scenario to avoid confusion. If no drilling dysfunction is detected and the drilling dysfunction probabilities do not suggest multiple possible dysfunctions, the probability that there is no drilling dysfunction is compared against a preset threshold. If the threshold is exceeded, "good drilling" is reported and the drilling cone turns into a circle to indicate that the driller should maintain the current drilling parameters. If the threshold for good drilling is not exceeded, "no comment" is reported, and no drilling cone is presented.

As mentioned briefly above, FIG. 9 illustrates a user interface that provides a driller with real time suggested drilling modifications based on the various dysfunctions detected by the system. In embodiments, the system determines the dysfunction that is most concerning, and provides a visual indication of drilling modifications needed to address the dysfunction. This may also be the case where only one dysfunction is determined.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Unless indicated otherwise, not all steps listed in the various figures need be carried out in the specific order described.

The invention claimed is:

1. A method for monitoring and controlling a downhole drilling operation, comprising:

providing a Bayesian network system including input nodes and a slide drilling dysfunction output node, wherein the input nodes include:

a downhole mechanical specific energy trend input node;

a downhole bit aggressiveness trend input node;

a differential pressure trend input node;

a minimum buckling load input node;

a downhole weight on bit versus surface weight on bit ratio input node; and a toolface efficiency index input node;

receiving information from one or more sensors on a drilling rig associated with each of the respective input nodes;

determining, via the Bayesian network, a probability of a dysfunction with the downhole drilling operation based on the information from the one or more sensors for each of the respective input nodes; and outputting, via the slide drilling dysfunction output node, an overall drilling dysfunction of the downhole drilling operation based, at least partially, on the probability of the dysfunction associated with each of the input nodes.

2. The method of claim 1, wherein, if the overall drilling dysfunction indicates buckling, reducing the differential pressure based on the respective input node.

3. The method of claim 2, wherein, if the overall drilling dysfunction indicates bit bounce, increasing a flow rate of a drilling fluid from an original flow rate and monitoring bit bounce for a predetermined period of time.

4. The method of claim 3, wherein, if after the predetermined period of time the overall drilling dysfunction indicates bit bounce, returning the flow rate of the drilling fluid to the original flow rate and reducing the differential pressure.

5. The method of claim 4, wherein, if the overall drilling dysfunction indicates stick or slip, increasing the flow rate of the drilling fluid and decreasing the differential pressure.

6. The method of claim 5, wherein, if the overall drilling dysfunction indicates high friction, implementing a different pipe rocking routine.

7. The method of claim 6, wherein, if the overall drilling dysfunction indicates poor toolface control, adjusting a drilling mode.

8. The method of claim 3, wherein, if the overall drilling dysfunction indicates stick or slip, increasing the flow rate of the drilling fluid and decreasing the differential pressure.

9. The method of claim 8, wherein, if the overall drilling dysfunction indicates high friction, implementing a different pipe rocking routine.

10. The method of claim 9, wherein, if the overall drilling dysfunction indicates poor toolface control, adjusting a drilling mode.

11. The method of claim 1, wherein a recommended corrective action is advised for resolving the overall drilling dysfunction.

12. The method of claim 11, wherein the recommended corrective action is embodied in a graphical user interface.

13. The method of claim 12, wherein the graphical user interface displays a drilling cone, wherein the drilling cone indicates a desired change of parameters in the direction of the cone.

14. A Bayesian network-based system for monitoring a downhole drilling operation, the Bayesian network-based system comprising:

at least two input nodes selected from the list consisting of:

a downhole mechanical specific energy trend input node;

a downhole bit aggressiveness trend input node;

a differential pressure trend input node;

a minimum buckling load input node;

a downhole weight on bit versus surface weight on bit ratio input node; and a toolface efficiency index input node;

wherein the at least two input nodes are configured to:

receive information from one or more sensors on a drilling rig, respectively; and determine a probability of a dysfunction with the downhole drilling operation based on the information from the one or more sensors;

a slide drilling dysfunction output node configured to output an overall drilling dysfunction of the downhole drilling operation based on the probability of the dysfunction determined by each of the at least two input nodes; and a recommended corrective action for resolving the overall drilling dysfunction.

15. The system of claim 14, wherein the at least two input nodes comprises three input nodes selected from the list consisting of:

the downhole mechanical specific energy trend input node;

the downhole bit aggressiveness trend input node;

the differential pressure trend input node;

the minimum buckling load input node;

the downhole weight on bit versus surface weight on bit ratio input node; and the toolface efficiency index input node.

16. The system of claim 14, wherein the at least two input nodes comprises four input nodes selected from the list consisting of:

the downhole mechanical specific energy trend input node;

the downhole bit aggressiveness trend input node;

the differential pressure trend input node;

the minimum buckling load input node;

the downhole weight on bit versus surface weight on bit ratio input node; and the toolface efficiency index input node.

17. The system of claim 14, wherein the at least two input nodes comprises five input nodes selected from the list consisting of:

the downhole mechanical specific energy trend input node;

the downhole bit aggressiveness trend input node;

the differential pressure trend input node;

the minimum buckling load input node;

the downhole weight on bit versus surface weight on bit ratio input node; and the toolface efficiency index input node.

18. The system of claim 14, wherein the at least two input nodes comprises six input nodes selected from the list consisting of:

the downhole mechanical specific energy trend input node;

the downhole bit aggressiveness trend input node;

the differential pressure trend input node;

the minimum buckling load input node;

the downhole weight on bit versus surface weight on bit ratio input node; and the toolface efficiency index input node.

19. The system of claim 14, wherein the recommended corrective action is embodied in a graphical user interface displaying a drilling cone, wherein the drilling cone indicates a desired change of parameters in the direction of the cone.

20. A method for monitoring downhole drilling operation comprising:

receiving, by a Bayesian network system, sensor data associated with a plurality of sensors;

determining a threshold feature for a first input node of the Bayesian network system;

determining a movement feature for a second input node of the Bayesian network system;

converting, via an output node of the Bayesian network system, the threshold feature and the movement feature to an output state;

converting the output state to a corrective action associated with an overall drilling dysfunction; and displaying the corrective action through a user interface.

* * * * *